US005673892A

United States Patent [19]

Kjellman

[11] Patent Number: 5,673,892

[45] Date of Patent: Oct. 7, 1997

[54] HUB FOR A ROTATABLE CHAIR

[75] Inventor: Helena Kjellman, Jakobstad, Finland

[73] Assignee: Oy Ortus Ab, Jakobstad, Finland

[21] Appl. No.: 545,800

[22] PCT Filed: May 6, 1994

[86] PCT No.: PCT/FI94/00176

§ 371 Date: Nov. 9, 1995

§ 102(e) Date: Nov. 9, 1995

[87] PCT Pub. No.: WO94/26149

PCT Pub. Date: Nov. 24, 1994

[30] Foreign Application Priority Data

May 12, 1993 [FI] Finland ..... 932158

[51] Int. Cl.[6] ..... F16M 13/00

[52] U.S. Cl. ..... 248/415; 248/188.7; 403/393

[58] Field of Search ..... 248/415, 416, 248/188.7, 188.8, 440; 403/393

[56] References Cited

U.S. PATENT DOCUMENTS

| | | | |
|---|---|---|---|
| 602,489 | 4/1898 | Trapp et al. . | |
| 1,498,213 | 6/1924 | Travers . | |
| 2,913,208 | 11/1959 | McKinley | 248/188.7 |
| 4,363,460 | 12/1982 | Carroll | 248/415 |
| 4,607,576 | 8/1986 | Kranjec | 248/188.8 X |
| 4,911,391 | 3/1990 | Ellis | 248/188.7 |
| 5,149,035 | 9/1992 | Bonnema et al. | 248/415 X |

FOREIGN PATENT DOCUMENTS

WO90/13242 11/1990 WIPO .

*Primary Examiner*—Ramon O. Ramirez

*Attorney, Agent, or Firm*—Marshall, O'Toole, Gerstein, Murray & Borun

[57] ABSTRACT

The present invention is related to a hub for a rotatable chair, said hub comprising an essentially pyramidal body having its side faces (1) suited for the mounting of the chair's leg element (2) thereon and further including a centrally aligned cylindrical cavity (3) suited for accommodating the center rod (4) of the chair seat cushion. The hub is characterized in that the lower part of each side face (1) is flared outwardly forming a slanting flank (5) with at least one hole (6) suited to accommodate a fixing screw (7) adapted to be screwed from underneath the hub into each leg element (2), and that each side face (1) further includes an essentially radially projecting support element (8) adapted for insertion into a mating groove (9) provided to each leg element (2).

17 Claims, 2 Drawing Sheets

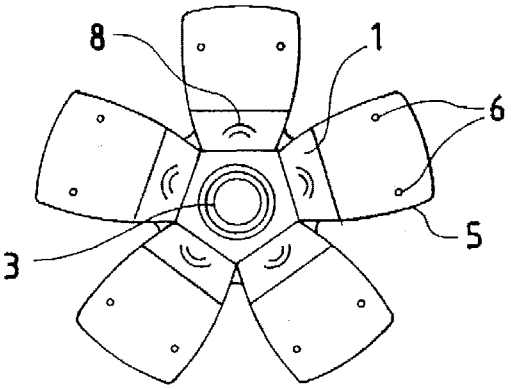
FIG. 1
FIG. 2
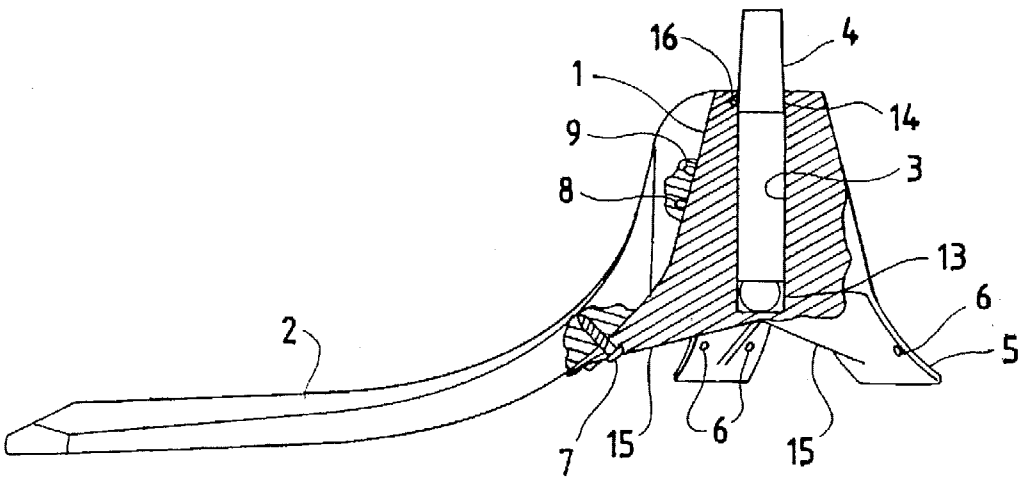
FIG. 3

HUB FOR A ROTATABLE CHAIR

The present invention relates to a hub for a rotatable chair, said base hub comprising an essentially pyramidal body having its side faces suited for the mounting of the chair's leg elements thereon and further incorporating a centrally aligned cylindrical cavity suited for accommodating the center rod of the chair seat cushion.

In prior-art constructions, the base hub for a rotatable chair with separate foot elements advantageously fabricated from wood has conventionally been shaped into a massive pyramidal metal piece, whose side faces have usually been provided with two relatively large threaded fixing holes; further, the hub construction has usually required a separate bearing sleeve for the center rod of the chair seat cushion. Accordingly, an expensive as well as work- and material-consuming construction results in which the relatively sturdy fixing screws remaining visible on the outer side of each leg element also remain visible in a manner degrading the otherwise most pleasing look of the chair.

It is an object of the present invention to overcome the above-described problems by providing a hub characterized in that the hub's underside, as an extension of each side face, has an outward slanting flank with at least one hole suited to accommodate a fixing screw adapted to be screwed from underneath the hub into each leg element, respectively, and that each side face additionally has an essentially radially projecting support element adapted for insertion into a mating groove provided to each leg element, respectively.

The hub according to the invention is superior to the prior art by providing a more economical construction with improved aesthetic look in which no fixing screws are visible. Moreover, the present construction has a higher strength and stability than the prior-art embodiments.

The best results are obtained by manufacturing the hub by injection moulding from a composite material including glass-fiber-reinforced thermoplastics such as polypropylene, polyamide or polycarbonate; alternatively, injection-moulded aluminium or zinc are also feasible materials.

Other characterizing properties of the invention are disclosed in the annexed claims 2–12.

The invention is next examined in greater detail with reference to the appended drawings, in which:

FIG. 1 is a side view of an exemplifying embodiment of the hub according to the invention;

FIG. 2 is a top view of the hub shown in FIG. 1;

FIG. 3 is a sectional view of the hub with a leg element mounted on it; and

Figure 4:
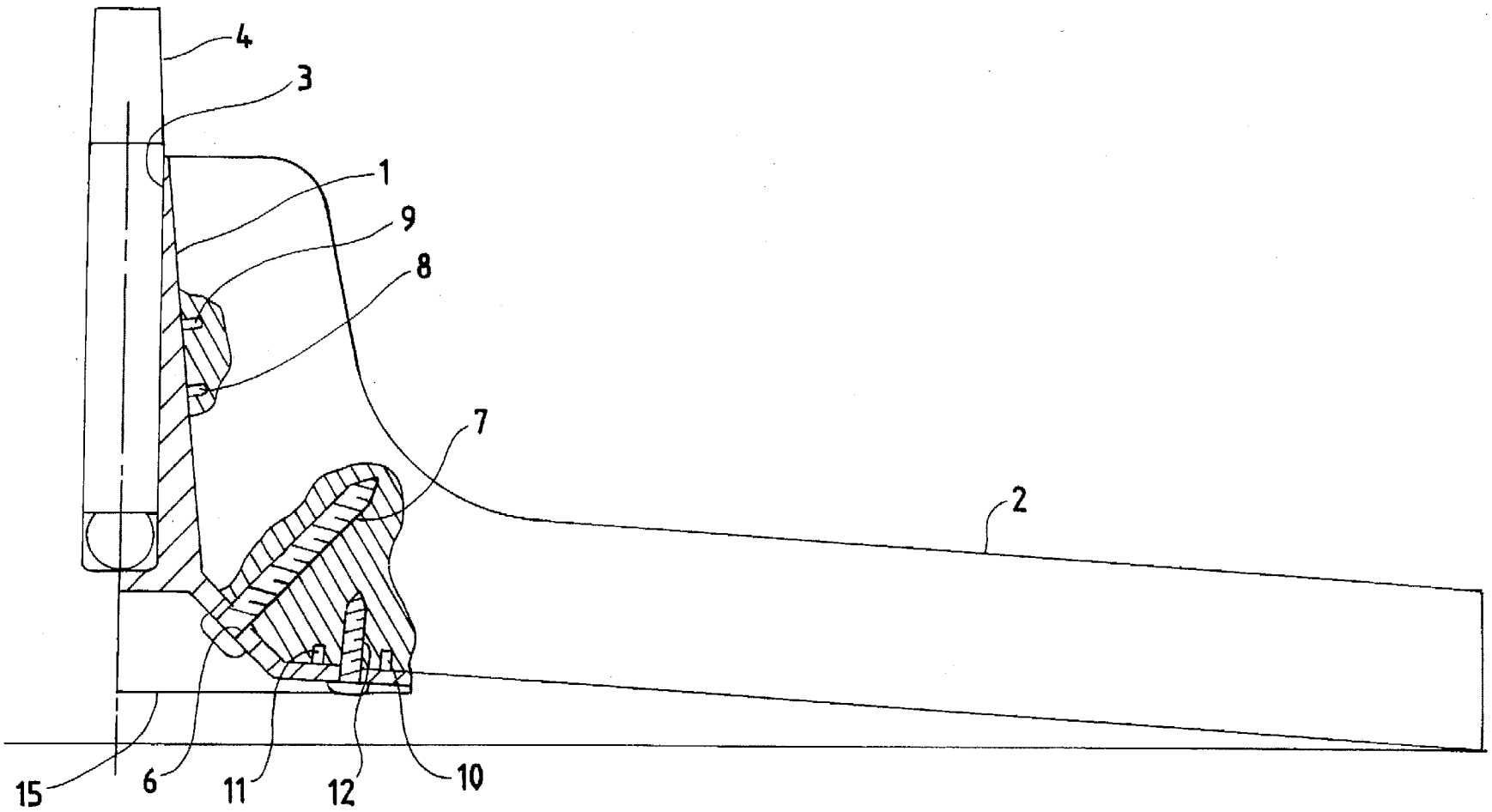
FIG. 4 is a side view of another embodiment of the hub according to the invention with a partially sectional view into the leg element through one of its side faces.

The hub according to the invention for a rotatable chair comprises an essentially pyramidal body having its side faces 1 suited for the mounting of the chair's leg element 2 thereon. The hub incorporates a centrally aligned cylindrical cavity 3 suited for accommodating the center rod 4 of the chair seat cushion. While FIGS. 1–3 show a hub designed for chair base having five leg elements 2, also constructions with three, four or six leg elements 2 are feasible for certain applications. Each side face 1 of the pyramidal hub at its lower part is flared outward forming a slanting flank 5 with at least one hole 6 suited to accommodate a fixing screw 7 adapted to be screwed from underneath the hub into each leg element 2, respectively. Additionally, each side face 1 has an essentially radially projecting support element 8 adapted for insertion into a mating groove 9 provided to each leg element 2, respectively. By means of these support elements 8 and grooves 9, an extremely stable and fail-proof mounting of the leg elements 2 to the hub is attained. Practically the entire force acting on the center rod 4 of the chair seat cushion is transmitted to the leg elements 2 via their support elements 8, respectively. The fixing screws 7, two of which are provided per each flank 5 as shown in FIGS. 1–3, principally only help to keep the leg elements 2 in place, whereby they are not subjected to any major stresses.

Shown in the drawing is a highly advantageous form of the support element 8, herein shaped into an upward open, semicircular arc. The groove 9 of the leg element 2 is accordingly shaped into a circular arc of a width, radius and depth of its cross section compatible with those of the support element 8. This arrangement results in a very sturdy construction capable of keeping the leg elements 2 in a fail-safe and absolutely stable manner in place.

FIG. 4 shows another embodiment of the hub according to the invention suited for mounting leg elements 2 of smaller height. In the same manner as above, also in this embodiment each flank 5 is additionally provided at its outer end with a second, essentially orthogonally projecting support element 10 with a shape essentially equal to that of the support element 8, said second support element 10 being adapted to fit into a mating, second groove 11 provided in each leg element 2, respectively. By means of this arrangement, each leg element 2 will be fixed in place with the help of two stationary support elements 8 and 10, wherein the center of the second support element 10 is advantageously provided with a hole for an additional fixing screw 12, the purpose of which is to prevent any gap remaining between the leg element 2 and the flank 5.

To assure that the center rod 4 of the chair seat cushion has no lateral play, the bottom of the cylindrical cavity 3 of the hub can be formed into, e.g., a spherically convex or conically upward tapering bearing peg against which the tubular or otherwise in a hollow-cored fashion to the lower part of the chair seat cushion formed center rod 4 rests and is thus firmly seated. The radius of the spherical surface of rotation forming the bearing peg, or alternatively, the bottom radius of the upward tapering conical bearing peg must be slightly larger than the inner diameter of the tube forming the center rod 4, or alternatively, the otherwise hollow center cavity at the lower end of the center rod 4 of the chair seat cushion. Then, the lower end of the center rod 4 will rest without any lateral play in the hub.

According to an alternative embodiment, the bottom of the hollow cavity 3 is shaped into a concave spherical seat suited to accommodate the insertion of a metal ball 13 with the same diameter as the concave spherical seat into the cavity, said ball having a diameter slightly larger than the diameter of the cavity at the lower end of the center rod 4. This arrangement gives a similar stabilizing effect to the end of eliminating the lateral play in the same manner as described for the first embodiment above, while the latter embodiment, however, offers a more durable design against wear.

Instead of using a separately inserted metal ball 13, at least the lowest part of the center rod can be formed by a metal rod whose lower end is rounded into a ball with the same diameter as that of the spherical bearing seat. This arrangement has the additional benefit that said bearing seat together with said ball-shaped end of the center rod can provide snap-fit locking between the rod end and the hub thus connecting the chair seat cushion to the chair leg part. To accomplish this, the bearing seat must be designed so deep that it forms a slightly deeper cavity than a mere hollow hemisphere, whereby the upper rim of the bearing seat forms within the cavity 3 a circumferential collar which acts as a snap-fit locking about the ball thus retaining the center rod 4 in the hub.

In still further possible embodiments, a snap-fit locking between the hub and the center rod 4 can be advantageously achieved by means of providing the upper end of the cavity 3 with a circumferentially running ring-shaped groove 14 suited to accept the snap-locking of a collar adapted about the perimeter of the center rod 4. The locking of the center rod may also be implemented by press-fitting a lock ring 16 or similar element to the groove 14 after the center rod 4 has been inserted into the hub. Such an operation is facilitated by designing the upper part of the center rod 4 slightly conical.

As mentioned above, the hub can be advantageously manufactured by injection moulding from a composite material including glass-fiber-reinforced thermoplastics such as polypropylene, polyamide, or alternatively, polycarbonate. Owing to the high strength of such a material, the injection-moulded hub can have a relatively thin material thickness on both the side faces 1, the flanks 5 and the cavity 3, whereby the required stability and strength is imparted by a number of horizontal stiffening ribs 15 which extend radially outward from the outer wall of the cavity 3 toward both the midparts and the sides of each side face 1 and the corresponding flank 5 of the hub, respectively, and partly also by smaller stiffening ribs which principally run along the edges of the flanks 5 and simultaneously conceal the holes 6 for the fixing screws 7 that in the hub according to the invention are conventional wood screws.

I claim:

1. A hub for a rotatable chair, said hub comprising an essentially pyramidal body having its side faces (1) suited for the mounting of the chair's leg elements (2) thereon and further including a centrally aligned cylindrical cavity (3) suited for accommodating the center rod (4) of the chair seat cushion, characterized in that in the hub the lower part of each side face (1) is flared outwardly to form a slanting flank (5) with at least one hole (6) suited to accommodate a fixing screw (7) adapted to be screwed from underneath the hub into each leg element (2), and that each side face (1) further includes an essentially radially projecting support element (8) adapted for insertion into a mating groove (9) provided to each leg element (2).

2. A hub of claim 1, wherein the support element (8) is shaped into an upwardly open, semicircular arc and that the groove (9) of the leg element is shaped into a circular arc of a width, radius, and depth of its cross section compatible with those of the support element (8).

3. A hub of claim 2, wherein each flank (5) has two parallel holes (6) suited to accommodate fixing screws (7).

4. A hub of claim 2, wherein each flank (5) is additionally provided close to its outer end with a second, essentially orthogonally projecting support element (10) adapted to fit into a mating, second groove (11) provided in its respective leg element (2).

5. A hub of claim 4, wherein an additional fixing screw (12) is disposed at the center of said second support element (10).

6. A hub of any one of claims 1–5, wherein the bottom of the cylindrical cavity (3) of the hub is formed into a spherically convex or conically upwardly tapering bearing peg acting as a bearings seat for the lower part of the chair seat cushion center rod (4).

7. A hub of claim 6, wherein the upper end of the cylindrical cavity (3) of the hub is provided with a circumferentially running ring-shaped groove (14), which in cooperation with a collar adapted about the perimeter of the center rod (4) of the chair seat cushion, or alternatively, a lock ring (16) press-fitted into said groove (14) makes a snap-fit locking between the hub and the center rod (4).

8. A hub of claim 6, wherein the lower part of the chair seat center rod is tubular.

9. A hub of any one of claims 1–5, wherein the bottom of the cylindrical cavity (3) of the hub is formed into a spherically concave bearing seat to accommodate the insertion of a metal ball (13) against which the lower part of the chair seat cushion center rod (4) can rest.

10. A hub of claim 9, wherein the upper end of the cylindrical cavity (3) of the hub is provided with a circumferentially running ring-shaped groove (14), which in cooperation with a collar adapted about the perimeter of the center rod (4) of the chair seat cushion, or alternatively, a lock ring (16) press-fitted into said groove (14) makes a snap-fit locking between the hub and the center rod (4).

11. A hub of claim 9, wherein the lower part of the chair seat center rod is tubular.

12. A hub of any one of claims 1–5, wherein the bottom of the cylindrical cavity (3) of the hub is formed into a spherically concave bearing seat to accommodate the lower end of the center rod (4) having a mating spherically convex shape.

13. A hub of claim 12, wherein said bearing seat is designed so deep as to form a slightly deeper cavity than a hollow hemisphere, whereby the upper rim of the bearing seat forms a snap-fit locking with the spherical end of the center rod (4).

14. A hub of claim 1, wherein the hub is manufactured by injection moulding from a composite material.

15. A hub of claim 14, wherein said composite material is a glass-fiber-reinforced thermoplastic.

16. A hub of claim 15, wherein said thermoplastic is selected from the group consisting of polypropylenes, polyamides, and polycarbonates.

17. A hub of claim 1, wherein the hub is manufactured by injection molding from aluminum or zinc.

* * * * *